US007114979B1

(12) United States Patent
Lai

(10) Patent No.: US 7,114,979 B1
(45) Date of Patent: Oct. 3, 2006

(54) STRUCTURE OF CONDUCTIVE SHEET IN SOCKET

(76) Inventor: Li-Chun Lai, 21F-1, No. 33, Sec. 1, Minsheng Rd., Panciao City, Taipei County (TW)

( * ) Notice: Subject to any disclaimer, the term of this patent is extended or adjusted under 35 U.S.C. 154(b) by 19 days.

(21) Appl. No.: 11/199,070

(22) Filed: Aug. 9, 2005

(51) Int. Cl.
*H01R 4/50* (2006.01)

(52) U.S. Cl. ..... 439/346; 439/103

(58) Field of Classification Search ..... 439/346, 439/102, 103, 290, 291
See application file for complete search history.

(56) References Cited

U.S. PATENT DOCUMENTS 2,326,327 A * 8/1943 Brewer ..... 439/291
3,083,345 A * 3/1963 Scheller ..... 439/291
3,169,814 A * 2/1965 Collins ..... 439/290
3,178,669 A * 4/1965 Roberts ..... 439/291
5,893,772 A * 4/1999 Carmo et al. ..... 439/346
5,921,799 A * 7/1999 Forrester ..... 439/346
6,065,987 A * 5/2000 Bigotto ..... 439/290
6,287,131 B1 * 9/2001 Deng ..... 439/103
6,619,975 B1 * 9/2003 Bentley et al. ..... 439/346

* cited by examiner

*Primary Examiner*—Tulsidas C. Patel
*Assistant Examiner*—Vladimir Imas
(74) *Attorney, Agent, or Firm*—Kao H. Lu, Esquire

(57) ABSTRACT

A conductive sheet in a socket comprises a conductive sheet body having a conductive terminal on the rear end and two parallel conductive pins on the front end with an inserting slot formed therebetween. One of the conductive pins is provided with a recess, ring or projection. When the conductive sheet of the plug is inserted to the inserting slot of the conductive sheet in the socket, the recess, ring or projection provided on one conductive pin in the conductive sheet body corresponds to the hole of the conductive sheet of the socket, such the hole of the conductive sheet is uncovered. A latching means within the socket can enter the hole of the conductive sheet through the recess, ring or projection to lock the conductive sheet of the plug. In this way, the plug cannot be drawn from the socket.

6 Claims, 5 Drawing Sheets

STRUCTURE OF CONDUCTIVE SHEET IN SOCKET

BACKGROUND OF THE INVENTION

1. Field of the Invention

The present invention relates to an improved structure of a conductive sheet in a socket, and particularly to a conductive sheet body, in which the front edge of one pin is provided with a recess, ring or a projection so that a latching means within the socket can lock the conductive sheet of a plug by the recess, ring or projection.

2. Description of the Related Art

With reference to FIGS. 1 and 2, a conventional conductive sheet 5 in a socket 7 is shown. The conventional conductive sheet 5 in the socket 7 mainly comprises two parallel conductive pins 51, such that an inserting slot 52 is formed between the two conductive pins 51 for the insertion of a conductive sheet 61 of a plug 6. Then, the electric power can be conducted to electric appliances through the conductive pins 51 of the conductive sheet 5 and the conductive sheet 61 of the plug 6. However, the conventional conductive sheet 5 has a function of conducting the electric power, both sides of a hole 611 provided on the front end of the conductive sheet 61 will be covered by the pins 51 of the conductive sheet 5 when the conductive sheet 61 of the plug 6 is inserted into the inserting slot 52 of the conductive sheet 5. As a result, the hole 622 provided on the conductive sheet 61 of the plug 6 cannot be locked. Therefore, since the conventional conductive sheet 5 in the socket 7 is not provided with a latching means, the plug 6 cannot be locked in the socket 7.

In view of the above, the conventional conductive sheet in the socket has many drawbacks, and really needs to be improved.

In view of the above problems in the conventional conductive sheet in the socket, the inventor of the present invention thus employs his expert experiences in this field to propose an improved structure of the conductive sheet in the socket.

SUMMARY OF THE INVENTION

The present invention is to provide an improved structure of the conductive sheet in the socket, wherein the front end of one conductive pin is provided with a recess, ring or projection, such that the hole provided on the front end of the conductive sheet of the plug can be uncovered. The latching means within the socket can lock into the hole of the conductive sheet of the plug and thus lock the plug.

Another, the present invention is to provide an improved structure of the conductive sheet in the socket which is simple in structure, easy to produce, and excellent in practicability.

In order to achieve the objects, the conductive sheet in the socket of the present invention comprises a conductive sheet body provided in the socket. The rear end of the conductive sheet body is provided with a conductive terminal projecting from the rear end of the socket for connecting to a power supply line. The front end of the conductive sheet body is provided with first and second conductive pins which are parallel with each other. An inserting slot is formed between the first and second conductive pins to correspond to the inserting hole of the socket. A recess, ring or projection is provided near the front end of the second conductive pin. When the conductive sheet of the plug is inserted to the inserting slot of the conductive sheet in the socket through the inserting hole of the socket, one side of the hole provided on the front end of the conductive sheet is covered by the first conductive pin, but the other side of the hole is uncovered due to the corresponding recess, ring or projection of the second conductive pin. Thus, a latching means within the socket can lock into the hole of the conductive sheet of the plug by the recess, ring or projection of the second conductive pin of the conductive sheet body, such that the conductive sheet of the plug can be properly locked in position.

These features and advantages of the present invention will be fully understood and appreciated from the following detailed description of the accompanying drawings.

DETAILED DESCRIPTION OF THE PREFERRED EMBODIMENT

Figure 1:
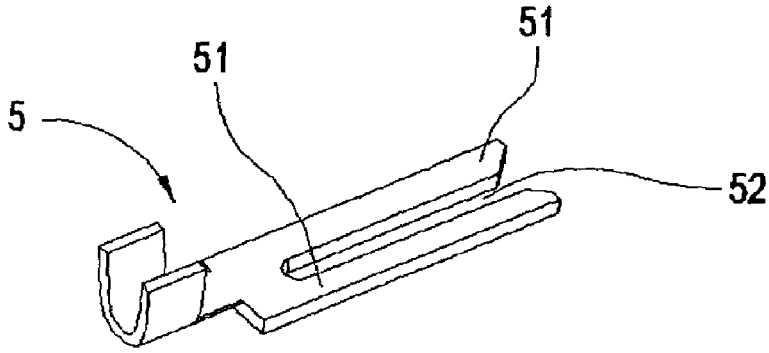
FIG. 1 is a perspective view of a conventional conductive sheet in a socket.
Figure 2:
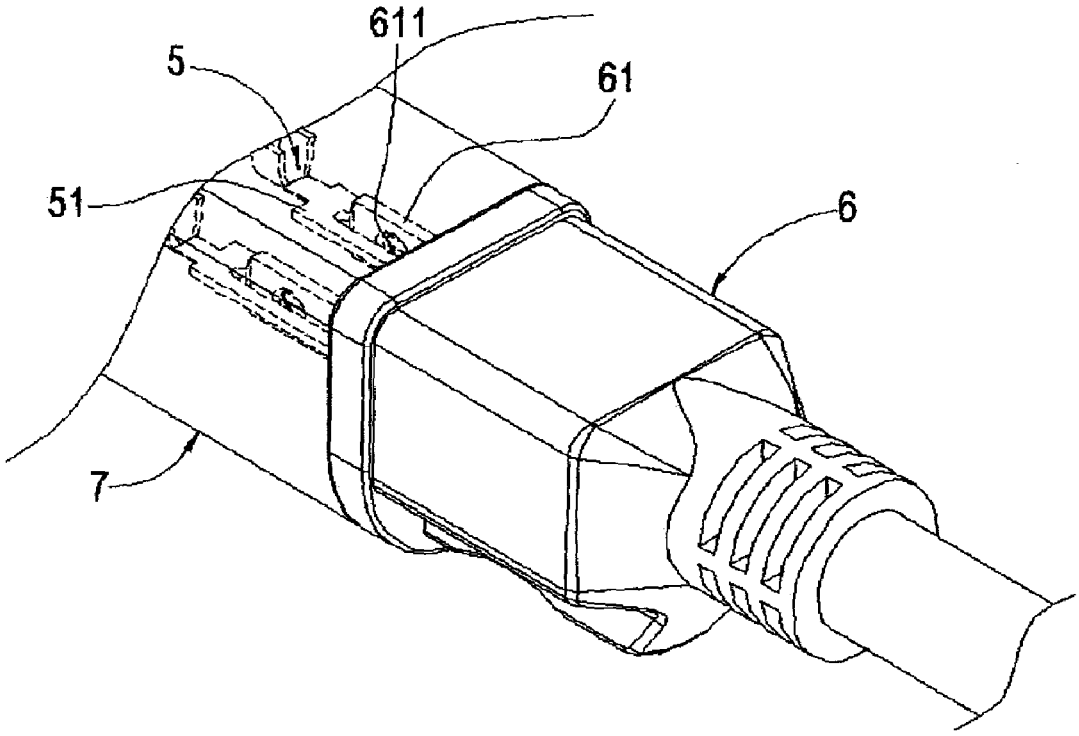
FIG. 2 is a schematic view showing the operation of the conventional conductive sheet in a socket.
Figure 3:
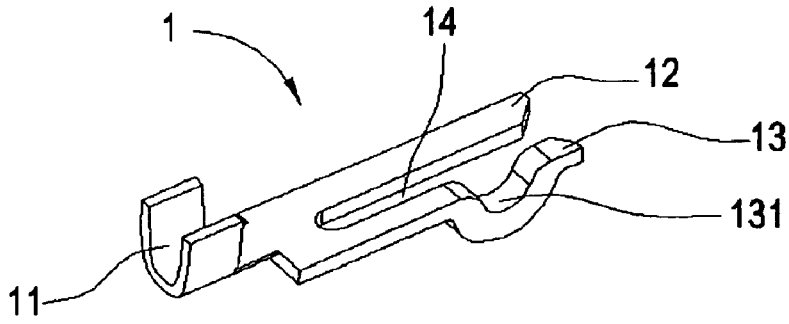
FIG. 3 is a perspective view showing a structure of the conductive sheet in the socket of the present invention.
Figure 4:
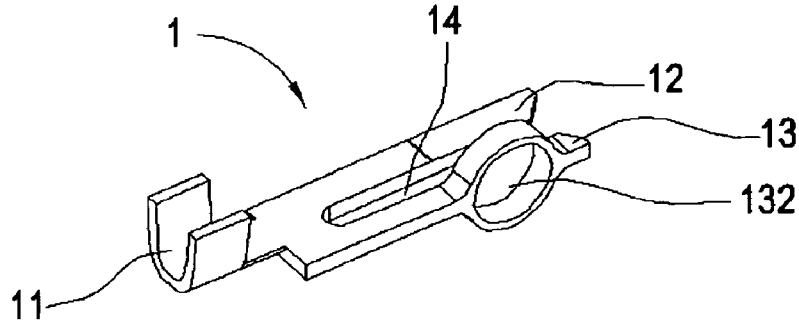
FIG. 4 is a perspective view showing another structure of the conductive sheet in the socket of the present invention.
Figure 5:
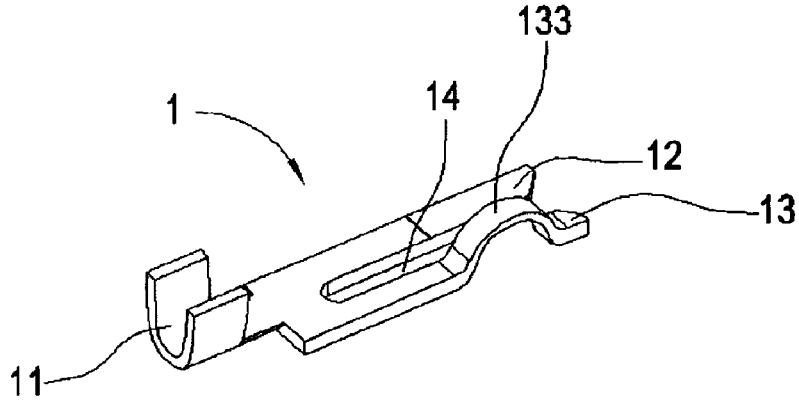
FIG. 5 is a perspective view showing another structure of the conductive sheet in the socket of the present invention.

With reference to FIGS. 3 to 5, the conductive sheet in the socket of the present invention mainly comprises the following members.

A conductive sheet body 1 is provided. The rear end of the conductive sheet body 1 is provided with a conductive terminal 11, and the front end thereof is provided with a first conductive pin 12 and a second conductive pin 13 which are parallel with each other, such that an inserting slot 14 is formed between the first and second conductive pins 12, 13. A recess 131, ring 132 (as shown in FIG. 4) or projection 133 (as shown in FIG. 5) is provided on the front end of the second conductive pin 13. The length of the first conductive pin 12 can be identical to or different from that of the second conductive pin 13. Further, the recess 131, ring 132 or projection 133 can be similarly provided on the front end of the first conductive pin 12. The position of the recess 131, ring 132 or projection 133 is not limited to that shown in this embodiment.

Figure 6A:
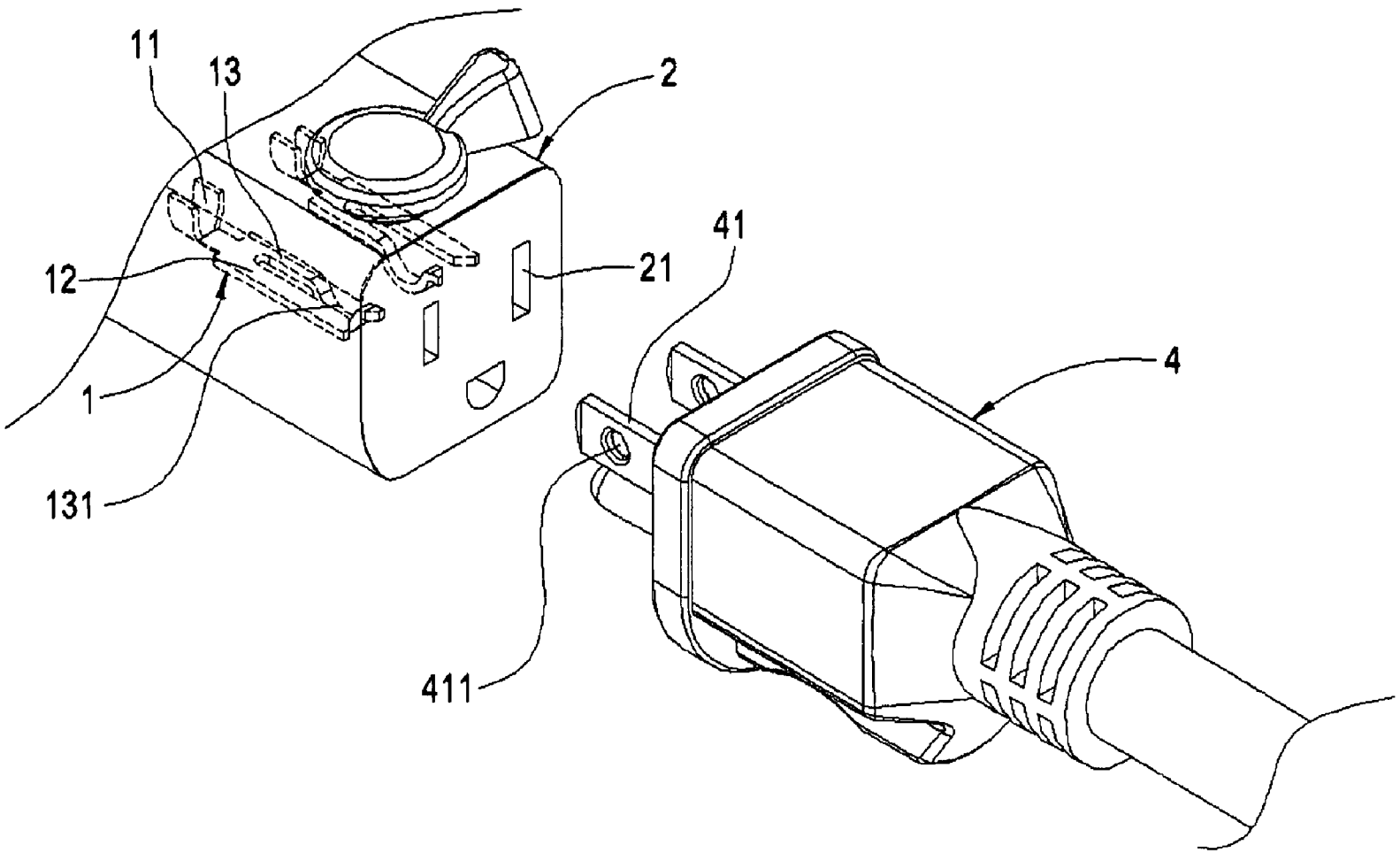
FIGS. 6A, 6B and 6C are schematic views showing the operation of the conductive sheet in a socket of the present invention.
Figure 6B:
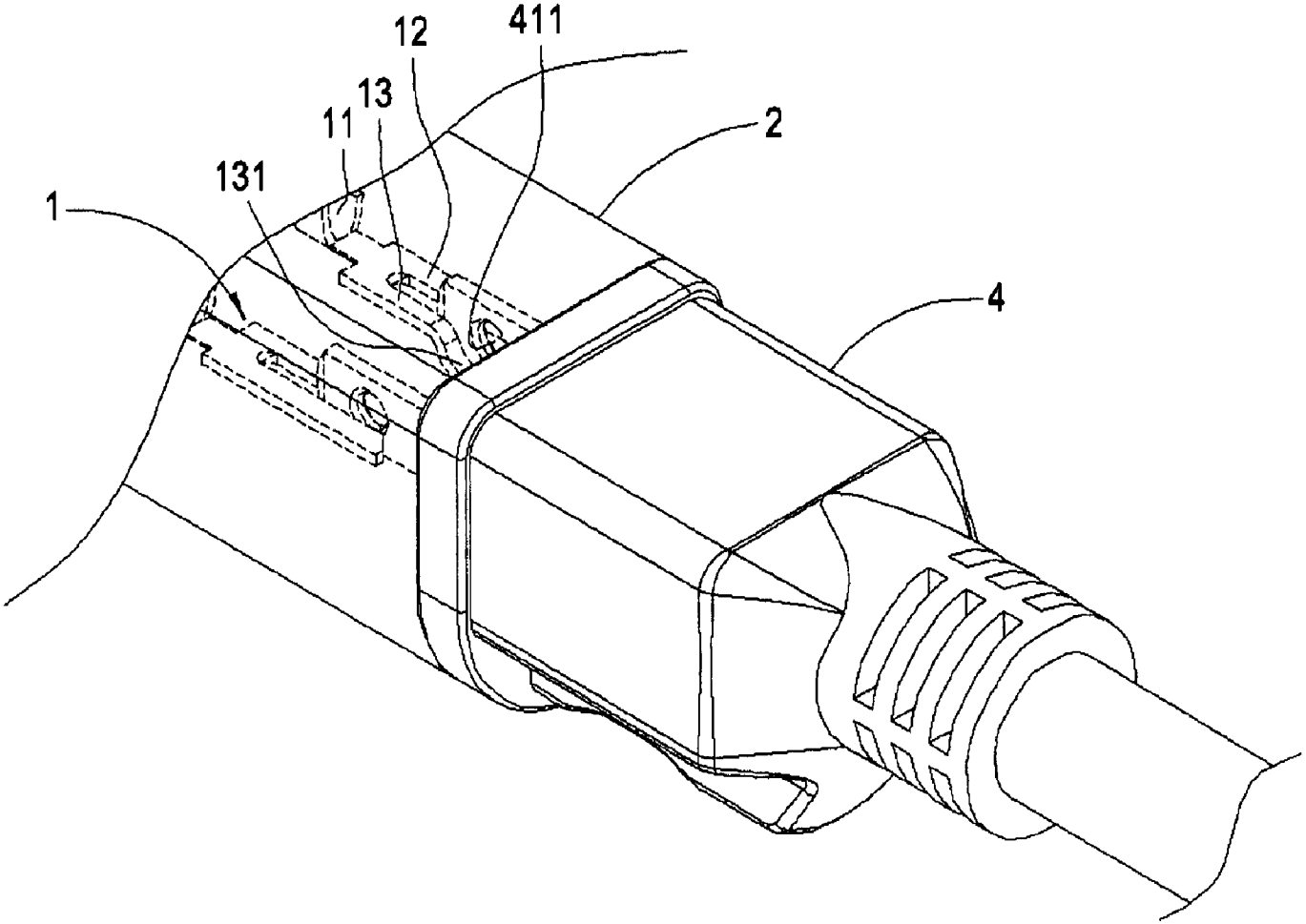
Figure 6C:
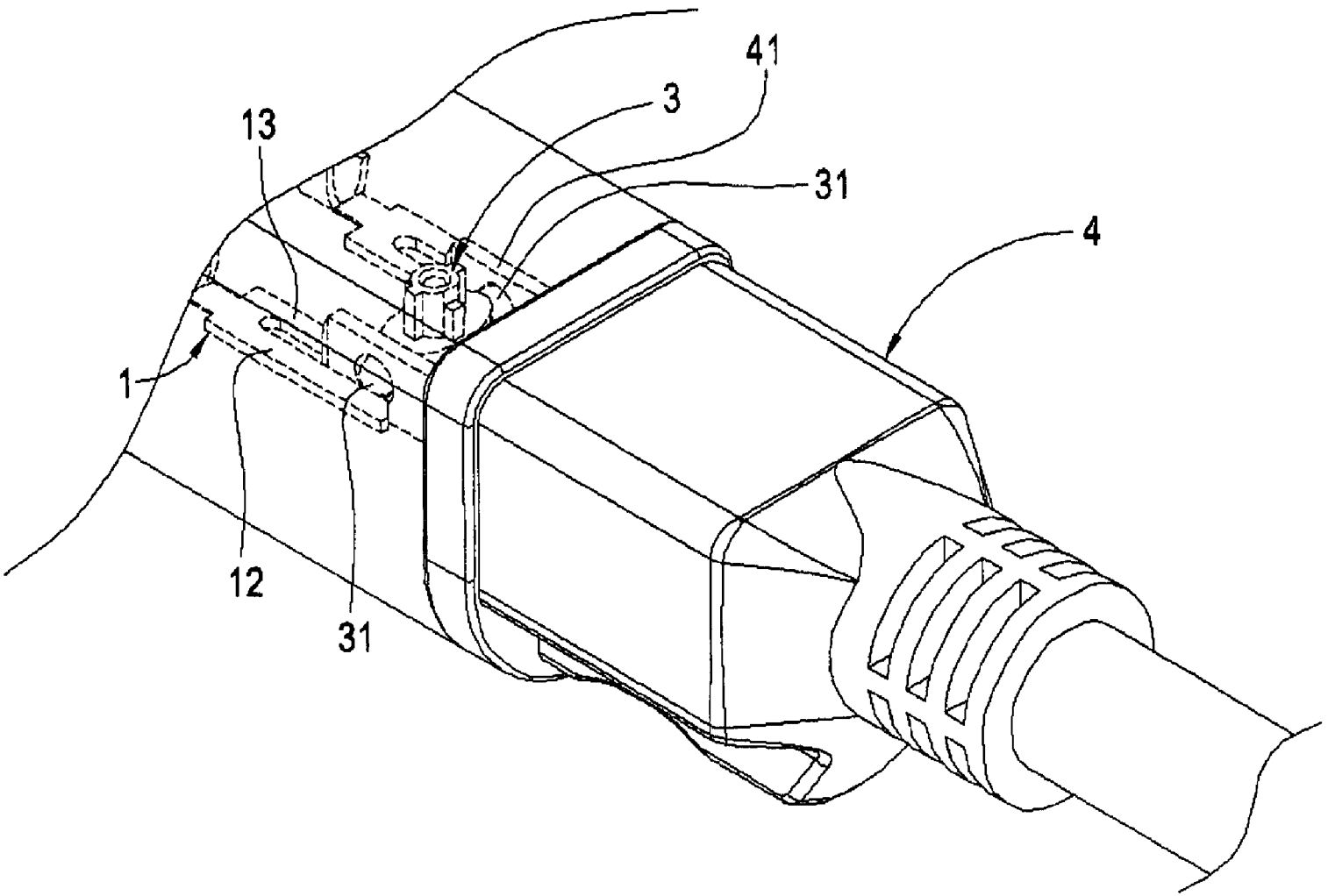

Next, with reference to FIGS. 6A, 6B and 6C, the operation of the present invention is shown. Two conductive sheet bodies 1 are combined into a socket 2, and the conductive terminal 11 provided on the rear end of the conductive sheet body 1 is exposed to the rear end of the socket 2. The inserting slot 14 on the front end of the conductive sheet body 1 corresponds to the inserting hole 21 of the socket 2. The second conductive pin 13 of the conductive sheet body 1 is positioned in a manner that the second conductive pin 13 having the recess 131, ring 132 or projection 133 is near the center of the socket 2 and corresponds to a latching piece of the latching means 3 within the socket 2. When the conductive sheet 41 of the plug 4 is inserted into the inserting slot 14 of the conductive sheet body 1 through the inserting hole 21 of the socket 2, the outer side face of the hole 411 provided on the front end of the conductive sheet 41 is covered by the first conductive pin 12 of the conductive sheet body 1, and the inner side face of the hole 411 corresponds to the recess 131, ring 132 or projection 133 of the second conductive pin 13. As a result, the latching piece 31 of the latching means 3 within the socket 2 can enter the hole 411 of the conductive sheet 41 of the plug 4 though the recess 131, ring 132 or projection 133 of the second conductive pin 13 to lock the conductive sheet 41. In this way, the plug 4 cannot be easily detached from the socket 2.

Thus, by providing the recess 131, ring 132 or projection 133 on the conductive pin 12 or 13 of the conductive sheet body and the latching means 3 within the socket 2, the plug 4 can be properly locked and positioned on the socket 2.

In comparison with conventional arts, the conductive sheet in the socket of the present invention has advantages as follows:

1. In the present invention, a recess, ring or projection is provided on the front end of one conductive pin, such that the hole provided on the front end of the conductive sheet of the plug is uncovered. In this way, the latching means within the socket can lock into the hole of the conductive sheet of the plug, and thus the plug can be properly locked and positioned.

2. The present invention is simple in structure, easy to produce, and excellent in practicability.

Many changes and modifications in the abovementioned embodiment of the present invention can, of course, be carried out without departing from the scope thereof. Accordingly, to promote the progress in science and useful arts, the present invention is disclosed and is intended to be limited only by the scope of the appended claims.

What is claimed is:

1. A conductive sheet in a socket comprising a conductive sheet body having a conductive terminal on the rear end and two conductive pins on the front end with an inserting slot formed therebetween to receive one of two conductive blades of a plug, wherein the front end of one conductive pin in the conductive sheet body is provided with a ring and the conductive blade has a hole corresponding to the ring as the plug is plugged in the socket to have the conductive blade inserted in the inserting slot so that a latching device of the socket is used to lock the conductive blade though the ring to prevent the plug from being easily detached from the socket.

2. The conductive sheet according to claim 1, wherein the lengths of the two conductive pins are the same.

3. The conductive sheet according to claim 1, wherein the lengths of the two conductive pins are different.

4. A conductive sheet in a socket comprising a conductive sheet body having a conductive terminal on the rear end and two conductive pins on the front end with an inserting slot formed therebetween to receive one of two conductive blades of a plug, wherein the front end of one conductive pin in the conducive sheet body is provided with a projection and the conductive blade has a hole corresponding to the projection as the plug is plugged in the socket to have the conductive blade inserted in the inserting slot so that a latching device of the socket is used to lock the conductive blade though the projection to prevent the plug from being easily detached from the socket.

5. The conductive sheet according to claim 4, wherein the lengths of the two conductive pins are the same.

6. The conductive sheet according to claim 4, wherein the lengths of the two conductive pins are different.

* * * * *